US011346116B1

(12) United States Patent
Contreras et al.

(10) Patent No.: US 11,346,116 B1
(45) Date of Patent: May 31, 2022

(54) BLOCK OUT CHAIR SYSTEM USED TO MAKE A BLOCK OUT OR A PASS-THROUGH IN A CONCRETE SLAB

(71) Applicants: Carlos Contreras, Pembroke Pines, FL (US); Reydel Santana, Miami, FL (US); Jose Barrios, Hialeah, FL (US)

(72) Inventors: Carlos Contreras, Pembroke Pines, FL (US); Reydel Santana, Miami, FL (US); Jose Barrios, Hialeah, FL (US)

( * ) Notice: Subject to any disclaimer, the term of this patent is extended or adjusted under 35 U.S.C. 154(b) by 0 days.

(21) Appl. No.: 17/587,879

(22) Filed: Jan. 28, 2022

(51) Int. Cl.
*E04G 15/06* (2006.01)
*E04G 15/04* (2006.01)

(52) U.S. Cl.
CPC ..... *E04G 15/06* (2013.01); *E04G 15/04* (2013.01)

(58) Field of Classification Search
CPC ..... E04G 15/04; E04G 15/06; E04G 15/063; E04G 15/068; B28B 7/16; B28B 7/164; B28B 7/18; B28B 7/186
USPC ..... 249/142, 177
See application file for complete search history.

(56) References Cited

U.S. PATENT DOCUMENTS 1,482,565 A * 2/1924 Johnson ..... E04G 15/061 249/177
1,603,245 A * 10/1926 Pederson ..... E04G 15/06 52/220.8
1,680,542 A * 8/1928 Hintze ..... E04G 15/061 52/220.8
2,684,518 A * 7/1954 Whitlock ..... E04G 15/00 52/220.8
2,728,126 A * 12/1955 Whitlock ..... B28B 23/00 52/220.8
3,004,320 A * 10/1961 Beckman ..... E04G 15/061 249/177
3,265,349 A * 8/1966 Hamrick ..... E04G 15/061 249/177
3,469,817 A * 9/1969 Bowden ..... E04G 15/063 249/177
4,077,599 A * 3/1978 Oland ..... B28B 7/28 249/177
4,084,780 A * 4/1978 Mess ..... E04B 1/4121 249/91
4,706,927 A * 11/1987 Lawall ..... B28B 7/18 249/188
4,915,346 A * 4/1990 Burdett ..... E04G 17/06 249/188

(Continued)

FOREIGN PATENT DOCUMENTS

DE 2311282 A1 * 9/1973 ..... B28B 7/186
DE 2552612 A1 * 5/1977 ..... B28B 7/18

(Continued)

*Primary Examiner* — Michael Safavi
(74) *Attorney, Agent, or Firm* — Ruben Alcoba, Esq.

(57) ABSTRACT

A block out chair system that is used to make a block out for a railing or to make a pass-through in a concrete slab. the block out chair system is a circular flat base that defines a circular aperture within the circular flat base, at least three supports that extend perpendicularly outward from the circular flat base, a hollow cylinder that has a perimeter wall that extends linearly outward from the at least three supports, the hollow cylinder defines a plurality of teeth that are configured to secure a foam cylinder, and a solid foam cylinder that is inserted within the hollow cylinder.

2 Claims, 5 Drawing Sheets

(56) References Cited

U.S. PATENT DOCUMENTS

| | | | | |
|---|---|---|---|---|
| 2013/0020460 | A1* | 1/2013 | Von Rummelhoff | B28B 7/30 249/142 |
| 2018/0258653 | A1* | 9/2018 | Gonzalez | E04G 15/063 |
| 2019/0024367 | A1* | 1/2019 | Shaw | B29C 48/32 |

FOREIGN PATENT DOCUMENTS

| | | | | |
|---|---|---|---|---|
| EP | 2492073 | A1 * | 8/2012 | B28B 19/0053 |
| GB | 1259385 | A * | 1/1972 | B28B 7/18 |
| KR | 20120033525 | A * | 4/2012 | E04G 16/06 |
| WO | WO-2016194251 | A1 * | 12/2016 | C08L 101/12 |
| WO | WO-2019182193 | A1 * | 9/2019 | E02D 29/0275 |

* cited by examiner

BLOCK OUT CHAIR SYSTEM USED TO MAKE A BLOCK OUT OR A PASS-THROUGH IN A CONCRETE SLAB

BACKGROUND

The present invention is directed to a block out chair system that is used to make a block out or a pass-through in a concrete slab.

Presently there is no singular product that can be used to make a block out or a pass-through in a concrete slab.

The construction industry makes a block out or a pass-through using a wood plank, a foam block out, and duct tape.

The problem with the present method is that when the concrete is poured on the area in which the block out or the pass through is desired, the block out or the pass-through shift from the position that it was originally placed.

The present invention was designed to be secured to a wooden platform in which the concrete would be poured. The present invention is a system that ensures that the block out or the pass-through does not laterally shift from the position in which it is initially placed.

The block out chair system of the present invention is made to ensure that the block out or the pass-through created in the concreate slab using the block out chair system is made in the exact position wherein the chair system was placed prior to pouring the concrete.

SUMMARY

The present invention a block out chair system that ensures that the block out or the pass-through created in the concreate slab using the block out chair system is made in the exact position wherein the block out chair system was placed prior to pouring the concrete.

The block out chair system of the present invention uses a block out chair that is made of a commercial grade plastic mold. The block out chair holds in place a foam block out that is used to embed any post of railing in a concrete slab. The block out chair is the product that holds the foam block out in its desired location without having any movement or shifting in the process of the concrete pour. The block out chair is nailed to a wood support structure in which concrete is to be poured.

The block out chair system of the present invention is used by contractors that need to place a block out in a concrete slab and need a way to hold a foam block out in place at the desired location, thereby ensuring that there is no movement of the foam block out at time of the concrete pour. The block out chair ensures that the foam block out will not shift during the concrete pour and thereby keeps the desired placement of the foam block out in the concrete slab during the pour. The block out chair of the block out chair system also keeps the foam block at the desired height, without shifting, during the concrete pour.

The block out chair system of the present invention keeps the foam block out used in the block out chair system from shifting during the concrete pour. By preventing the block out from shifting during the pour, the contractor saves the time and money required to correct the block out created in the concrete slab after the concrete is poured.

The block out chair of the present invention eliminates having to fabricate a rustic foam block out every time that a block out or a pass-through is needed on a concrete slab. A rustic foam block out is created using a wooden plank, a foam block out, and duct tape. The rustic foam block out is created by placing the foam block on the wooden plank and then using the duct tape to secure the foam block onto the wooden plank.

The old method of making foam block out is as follows: 1. cutting a piece of 1×4 lumber then duct tape or adhere the foam block out to the piece of wood by using manual labor and a makeshift jig; 2, then taking that and setting the piece of wood to the edge of the wood form that is sometimes missing at time of installation; 3. next, pouring the concrete around the foam block out (the piece of wood and block out is left cantilevered from the wood form at the mercy of the concrete during the pour and typically the block out is either moved or shifted from its original location or completely removed from wood); and 4. Lastly, after the concrete dries, removing the piece of wood piece that is attached to the block out.

A disadvantage of the old method of making a rustic foam block out chair is that when the foam block out shifts from its originally placed location, the contractor must manually correct the shift, thereby costing the contractor and time and money. Another disadvantage of the old method is the time that the laborer spends when making a rustic foam block out.

An object of the present invention is to provide a block out chair system that will prevent the shifting of a foam block out when concrete is poured on to a wooden support structure.

Another object of the present invention is to provide a block out chair system that will save time when placing a foam block out on a wooden support structure in which concrete is poured.

Yet another object of the present invention is to provide a block out chair system that will save a contractor from having to fix a block out that is incorrectly poured.

Still yet another object of the present invention is to provide a block out chair system that will save a contractor time and money.

DRAWINGS

These and other features, aspects, and advantages of the present invention will become better understood with regards to the following description, appended claims, and drawings where:

DESCRIPTION

Figure 1:
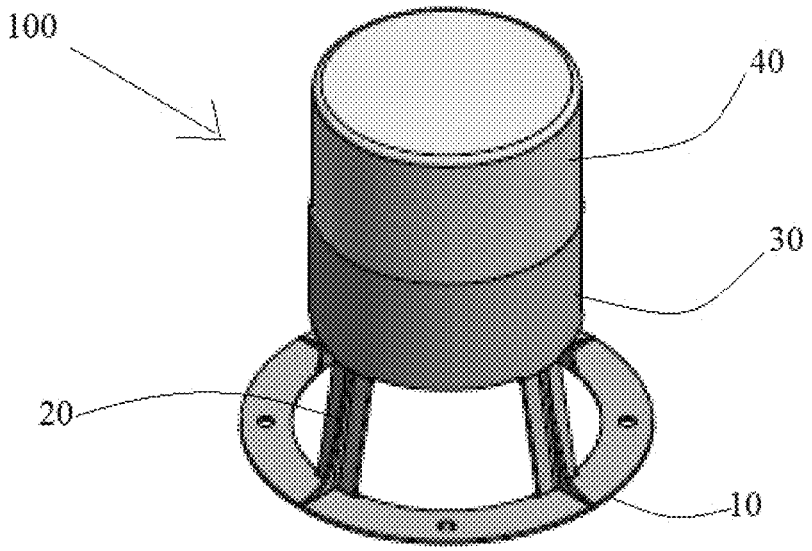
FIG. 1 is a perspective view of the present invention.
Figure 2:
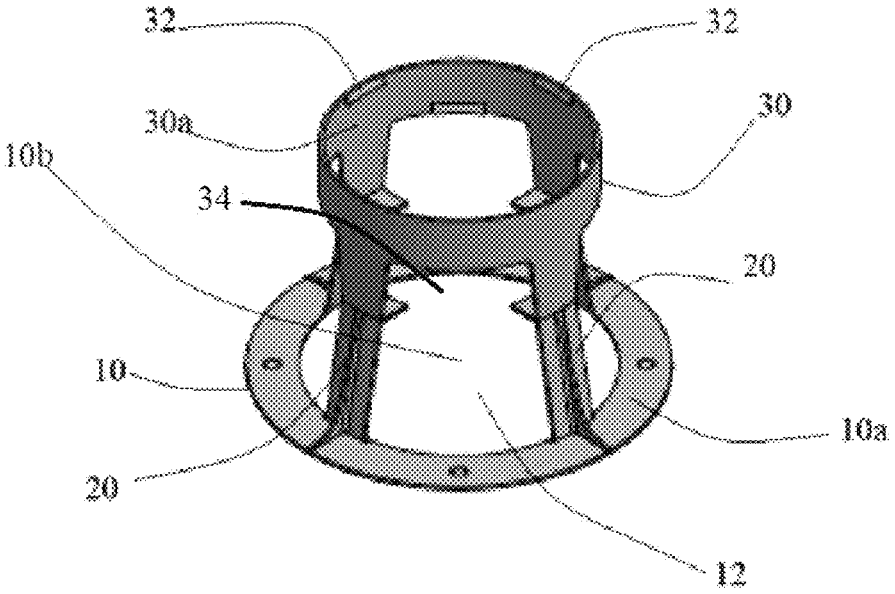
FIG. 2 is a perspective view of an embodiment of the present invention.
Figure 3:
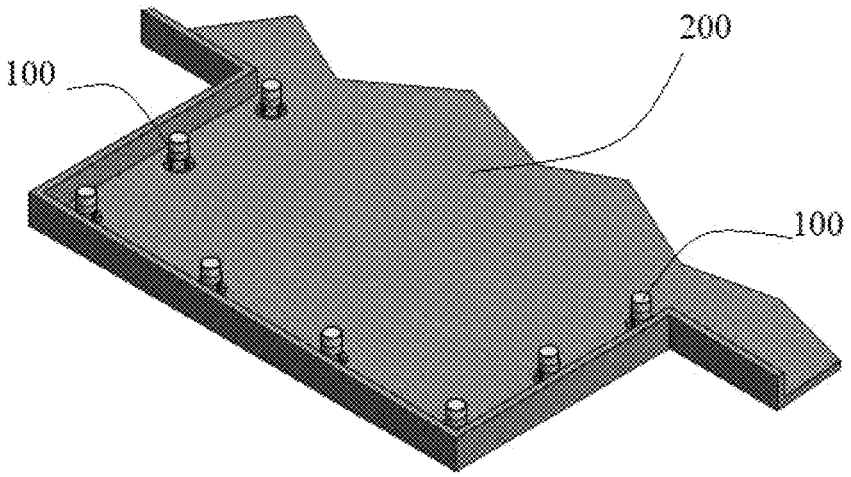
FIG. 3 is a perspective view of the present invention secured on a wood form.
Figure 4:
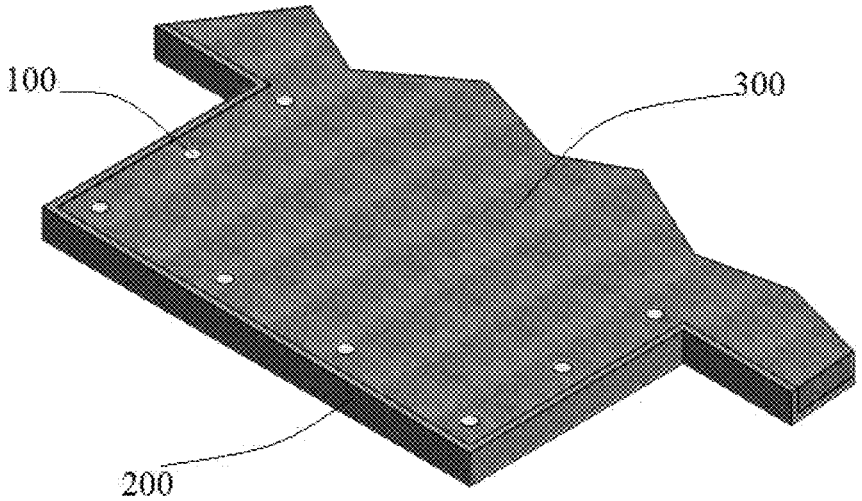
FIG. 4 is a perspective view of the present invention after a concrete have been poured on the wood form.
Figure 5:
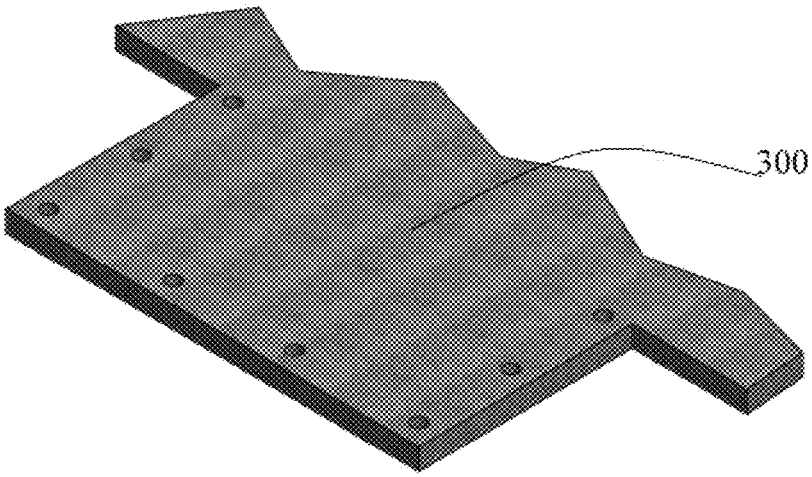
FIG. 5 is a perspective view of a concrete slab after the foam block out is removed from the concrete slab.
Figure 6:
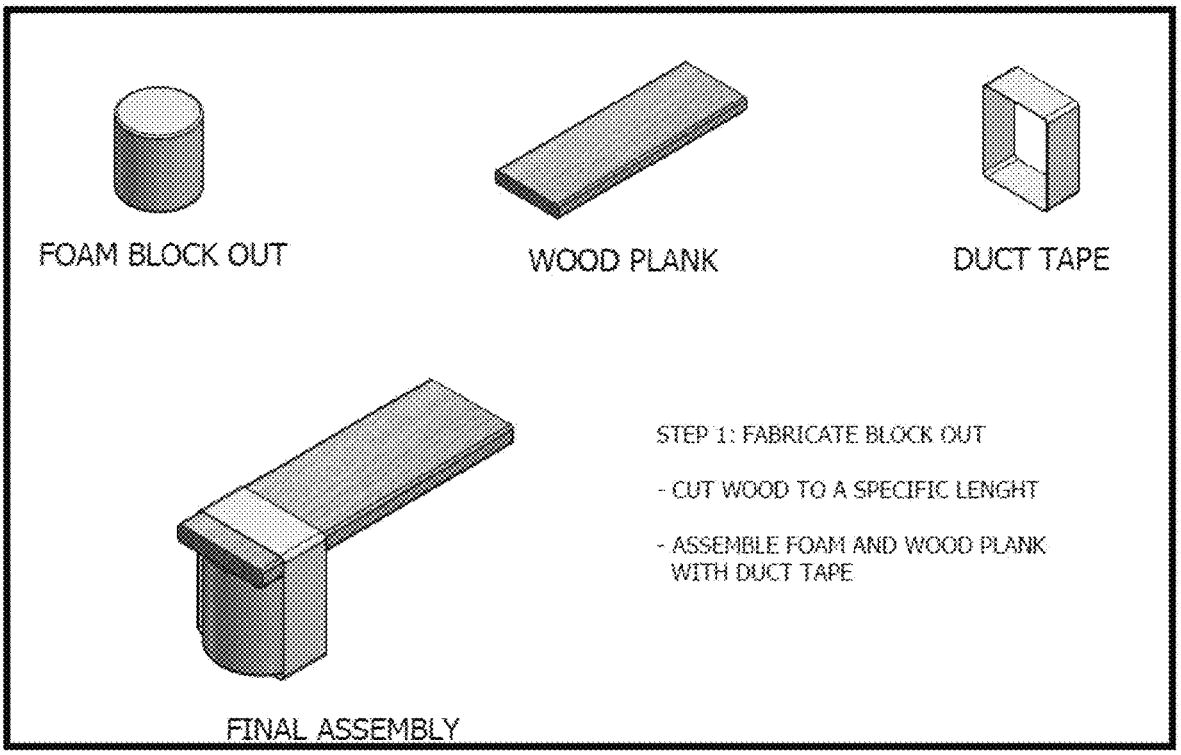
Fig. 6 Prior Art
FIG. 6 is a block diagram that shows all of the elements required to create a block out chair using the prior art.
Figure 7:
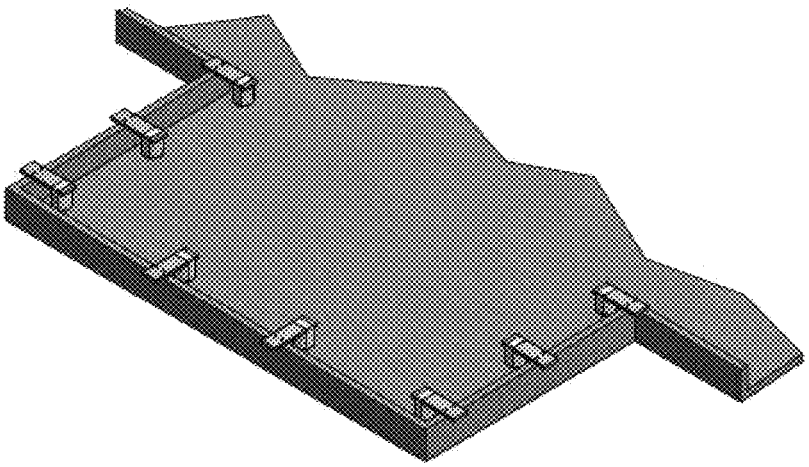
Fig. 7 Prior Art
FIG. 7 is a perspective view that shows how a block out chair of the prior art is placed on a wood form.
Figure 8:
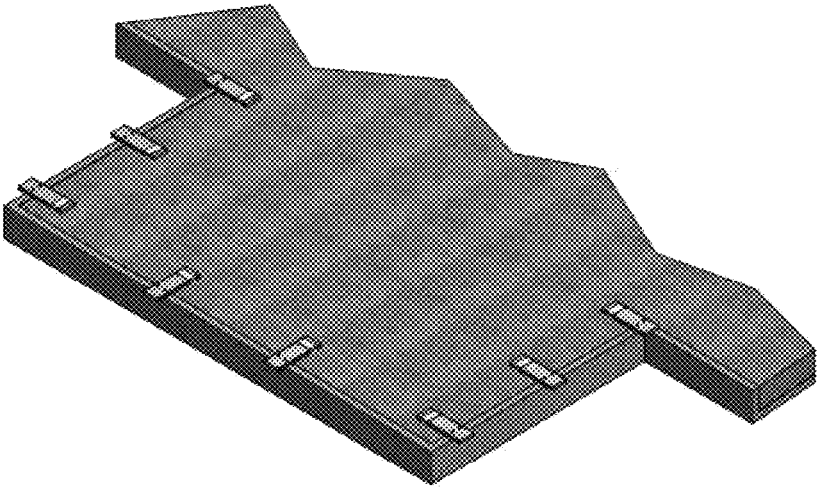
Fig. 8 Prior Art
FIG. 8 is a perspective view that shows how a block out chair of the prior art appears after concrete is poured on the wood form.
Figure 9:
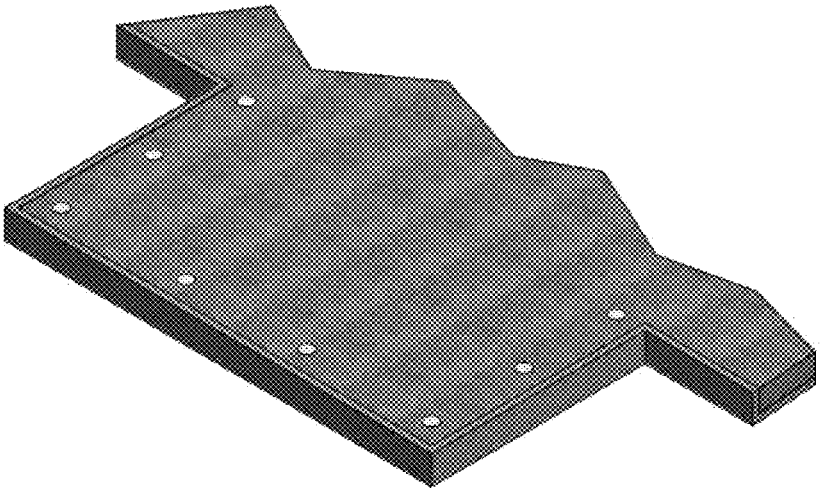
Fig. 9 Prior Art
FIG. 9 is a perspective view that shows a foam block out on the concrete slab and how the wood plank is separated from the foam block out.

As seen in FIGS. 1-2, the present invention is a block out chair system 100 that is used to make a block out for a railing or to make a pass-through in a concrete slab.

The block out chair system 100 comprises of a circular flat base 10 that defines a circular aperture 12 within the circular flat base, the circular aperture 12 has a diameter that in at least 4 inches in diameter and that is no more than 6 inches in diameter, the circular flat base 10 defines a solid ring 10*a* that is two inches in width, the flat circular base 10 is configured to be secured on a wooden form 200 that is used to create the block out or the pass through in the concrete slab 300. At least three supports 20 that extend perpendicularly outward from the circular flat base 10, the at least three supports 20 are equally distanced from each other and are all at an equal distance from the center of the circular flat base 10*b*. A hollow cylinder 30 that has a perimeter wall 30*a* that extends linearly outward from the at least three supports 20, and the perimeter wall 30*a* of the hollow cylinder 30 are from at least one inch in length and at most two inches in length, the hollow cylinder 30 defines a plurality of teeth 32 that are configured to secure a solid foam cylinder 40. And, a solid foam cylinder 40 that is at least 4 inches in diameter and that is no more than 6 inches in diameter that is inserted within the hollow cylinder 30.

In an embodiment of the present invention, the perimeter wall of the hollow cylinder defines at least one cutout 34.

An advantage of the present invention is that it provides a block out chair system that prevents the shifting of a foam block out when concrete is poured on to a wooden support structure.

Another advantage of the present invention is that it provides a block out chair system that saves time when placing a foam block out on a wooden support structure in which concrete is poured.

Yet another advantage of the present invention is that it provides block out chair system that saves a contractor from having to fix a block out that is incorrectly poured.

Still yet another advantage of the present invention is that it provides a block out chair system that saves a contractor time and money.

While the inventor's description contains many specificities, these should not be construed as limitations on the scope, but rather as an exemplification of several preferred embodiments thereof. Many other variations are possible. Accordingly, the scope should be determined not by the embodiments illustrated, but by the specification, the drawings, and the appended claims and their legal equivalents.

What is claimed is:

1. A block out chair system that is used to make a block out for a railing or to make a pass-through in a concrete slab, the block out chair system comprises:

a circular flat base that defines a circular aperture within the circular flat base, the circular aperture has a diameter that in at least 4 inches in diameter and that is no more than 6 inches in diameter, the circular flat base defines a solid ring that is two inches in width, the flat circular base is configured to be secured on a wooden form that is used to create the block out or the pass through in the concrete slab;

at least three supports that extend perpendicularly outward from the circular flat base, the at least three supports are equally distanced from each other and are all at an equal distance from the center of the circular flat base;

a hollow cylinder that has a perimeter wall that extends linearly outward from the at least three supports, and the perimeter wall of the hollow cylinder are from at least one inch in length and at most two inches in length, the hollow cylinder defines a plurality of teeth that are configured to secure a foam cylinder; and a solid foam cylinder that is at least 4 inches in diameter and that is no more than 6 inches in diameter that is inserted within the hollow cylinder.

2. The block out chair system that is used to make a block out for a railing or to make a pass-through in a concrete slab of claim 1, wherein the perimeter wall of the hollow cylinder defines at least one cutout.

* * * * *